US005440105A

United States Patent [19]

Kim

[11] Patent Number: 5,440,105

[45] Date of Patent: Aug. 8, 1995

[54] METHOD FOR CONTROLLING THE POSITION OF A COOKING VESSEL IN A COOKING APPLIANCE

[75] Inventor: Kyung D. Kim, Suwon, Rep. of Korea

[73] Assignee: Samsung Electronics Co., Ltd., Suwon, Rep. of Korea

[21] Appl. No.: 299,453

[22] Filed: Sep. 1, 1994

[30] Foreign Application Priority Data

Sep. 17, 1993 [KR] Rep. of Korea ..... 1993-19015

[51] Int. Cl.[6] ..... H05B 6/78

[52] U.S. Cl. ..... 219/754; 219/518; 99/443 R; 108/20; 126/338

[58] Field of Search ..... 219/754, 755, 518; 108/20, 21; 126/338; 99/443 R

[56] References Cited

U.S. PATENT DOCUMENTS 4,308,445 12/1981 Offutt ..... 219/754
4,714,811 12/1987 Gerling et al. ..... 219/754
4,939,333 7/1990 Haruo et al. ..... 219/754

FOREIGN PATENT DOCUMENTS

92/6271 8/1992 Rep. of Korea .

*Primary Examiner*—Philip H. Leung
*Attorney, Agent, or Firm*—Burns, Doane, Swecker & Mathis

[57] ABSTRACT

A cooking vessel placed in a desired orientation on a turntable on an oven is automatically returned to that desired orientation at the end of a cooking operation. A sensor on the floor of the cooking chamber senses the movement of support rollers of the turntable to determine the angle by which the turntable must be rotated at the end of the cooking operation to bring the cooking vessel back to the desired orientation.

7 Claims, 4 Drawing Sheets

METHOD FOR CONTROLLING THE POSITION OF A COOKING VESSEL IN A COOKING APPLIANCE

BACKGROUND OF THE INVENTION

Field of the Invention

The present invention is related to a method for controlling the position of a cooking vessel which is placed inside a cooking appliance which rotates the cooking vessel as it cooks the food, and particularly to a method for automatically returning the cooking vessel to the same position at the completion of the cooking cycle as when the cooking vessel was initially placed in the cooking appliance.

Description of the Prior Art

In order to prevent food from being unevenly cooked due to a concentration of energy (for example, convection heat energy or microwave energy), a conventional cooking appliance with a concentrated(non-dispersed) energy emitting source heats the food while it rotates the cooking vessel. This cooking appliance may be in the form of a microwave oven which heats food by employing the principle of dielectric heating, an oven range which bakes food by the radiant heat emitted from a heater, or a complex type cooking appliance which employs both heating methods described above.

FIG. 1A is a diagram illustrating the position of a cooking vessel at the beginning of the cooking cycle, and FIG. 1B is a diagram illustrating the position of the same cooking vessel at the completion of the cooking cycle.

First, the user seizes handles 11 and 11' of cooking vessel 10 and places the cooking vessel 10 onto turntable 20 located in the lower portion of cooking chamber 30. Next, the user selects the desired cooking time or the desired function key and starts the cooking cycle.

In the specification, the term "handle" is used for designating any specific part of the cooking vessel 10, with which the user easily grasps and maneuvers the cooking vessel 10.

After the initial placement of the cooking vessel 10, the relative location of the handles 11 and 11' from the user's viewpoint is not convenient because the cooking vessel 10 is rotated on the turntable 20 during the cooking cycle. That is, after the cooking cycle, the location of the handles 11 and 11' may be in a straight line away from the user as shown in FIG. 1B. In this case, this causes a difficulty in removing the cooking vessel 10 which is heated by means of the cooking cycle from the cooking compartment 30.

To solve the problem described above, a system which is capable of automatically returning the cooking vessel to the position where the cooking vessel was initially placed, is disclosed in detail in Korean Patent Publication No. 92 - 6271. The system comprises a means for storing the time period required for each rotation of a synchronous motor (i.e., a full-rotation period), whose rotation speed (rotation period) varies in proportion to the frequency of the power supply source, and a means for determining the number of of full-rotation periods transpire from the beginning of the cooking cycle. Even after the cooking cycle is completed, the system continues to drive the synchronous motor for a partial-rotation time period calculated by subtracting from the full-revolution period, any rotation time exceeding the previous full-rotation period, thereby automatically returning the cooking vessel to the position where the cooking vessel was initially placed at the beginning of cooking cycle.

However, the system has a problem in that the rotation of the synchronous motor may be controlled by a time value which is different from the actual rotation time due to variations in the frequency of the power supply source or the weight of the cooking vessel and food.

SUMMARY OF THE INVENTION

It is an object of the present invention to provide a method for precisely returning a cooking vessel to the same position where it was initially placed at the beginning of the cooking cycle in a cooking appliance which cooks food while the cooking vessel rotates, thereby providing easy access to the cooking vessel handles.

The method according to the present invention is adaptable to a cooking appliance which comprises a cooking compartment, a turntable for rotating the cooking vessel put thereon, a motor for rotating the turntable, a plurality of rollers for supporting the turntable and which rotates at a speed proportional to that of the turntable, and a means for sensing the passage of the supporting rollers, thereby providing a uniform methods for cooking food while the cooking vessel rotates. The method comprises the steps of beginning the cooking cycle by rotating the turntable; counting the number of times the supporting roller passes the sensing switch; counting the time (tx) from the moment the turntable begins to rotate to the moment the first coming supporting roller passes the sensing switch, and storing the time (tx); counting the time (ty) between the first and second coming supporting rollers, and storing the time (ty); calculating the time (tz) by subtracting time (tx) from time (ty), and storing the time (tz); repeatedly counting after every supporting roller passes the sensing switch; and, when the cooking cycle is completed, rotating the turntable until each supporting roller has passed the sensing switch an equal number of times and the time (tz) lapses.

The method may be adapted for use in a cooking appliance having two supporting rollers, but preferably in a cooking appliance having three or more supporting rollers in order to prevent application of an excessive force to the axis of the motor caused by the off-center placement of the cooking vessel on the turntable.

In the method, the completion of the cooking cycle may comprises either the actual completion of the cooking cycle according to the control program or the forced interruption of the cooking cycle by user.

BRIEF DESCRIPTION OF THE DRAWINGS

These and other aspects of the present invention are clarified in the accompanying drawings in which.

DETAILED DESCRIPTION OF THE PREFERRED EMBODIMENTS

Hereinafter, the preferred embodiments according to the present invention will be fully described, citing a microwave oven with a turntable as an example of a cooking appliance.

Figure 1A:
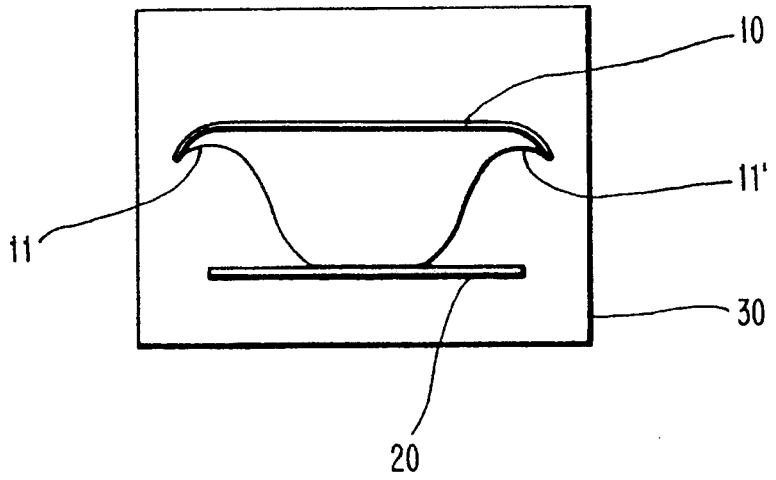
FIG. 1A (PRIOR ART)
FIG. 1A is a diagram illustrating the position of a cooking vessel at the beginning of the cooking cycle.
Figure 1B:
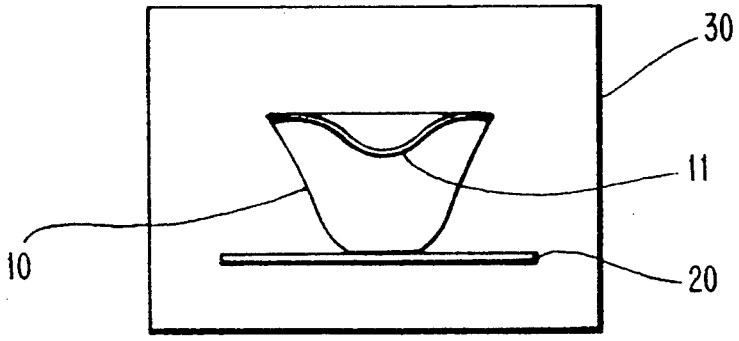
FIG. 1B (PRIOR ART)
FIG. 1B is a diagram illustrating the position of the same cooking vessel at the completion of the cooking cycle when the present invention is not used; and, FIG. 2 is a partial view of an oven showing a top view of the cooking compartment according to the present invention; and, FIGS. 3A and 3B are flow charts describing steps for carrying out a method of the present invention.
Figure 2:
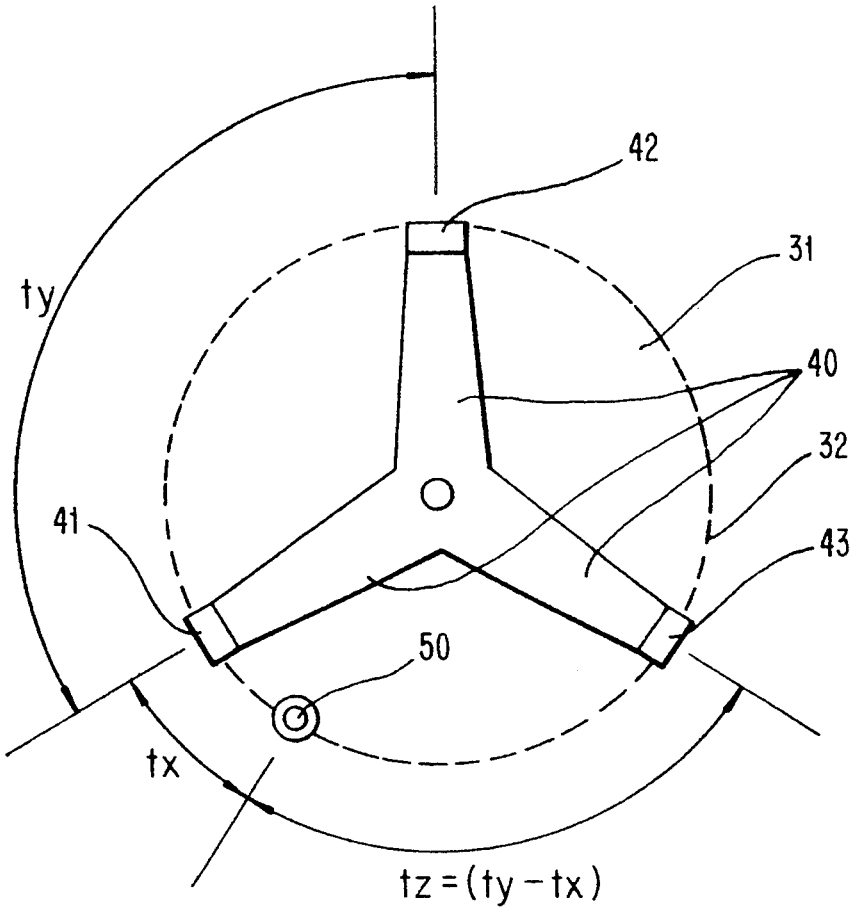

Referring to FIG. 2, supporting rollers 41 to 43 are is rotatably mounted at the outside end of respective radial supporting arms 40, each of which is designed to be the same length from the center and at the same angle to each other, to support a turntable (not shown) which rotates thereon. At least three supporting arms are preferable so that the turntable may be uniformly supported even when the positioning of the cooking vessel (not shown) is not centered on the turntable. The supporting rollers 41 to 43 should rotate about their respective axes at a speed proportional to that of the turntable, or, if possible at the same speed as the turntable. This may be achieved by forming a circular guiding groove ( not shown ) in the bottom surface 31 of the cooking compartment in order that the supporting rollers 41 to 43 may pass only along the path described by the broken line. Alternatively, the supporting rollers may be attached to the bottom surface of the turntable. A sensing switch 50, which generates and transmits a signal to a control section (not shown) whenever the supporting rollers 41 to 43 pass thereover, is mounted in the path 32.

Figure 3A:
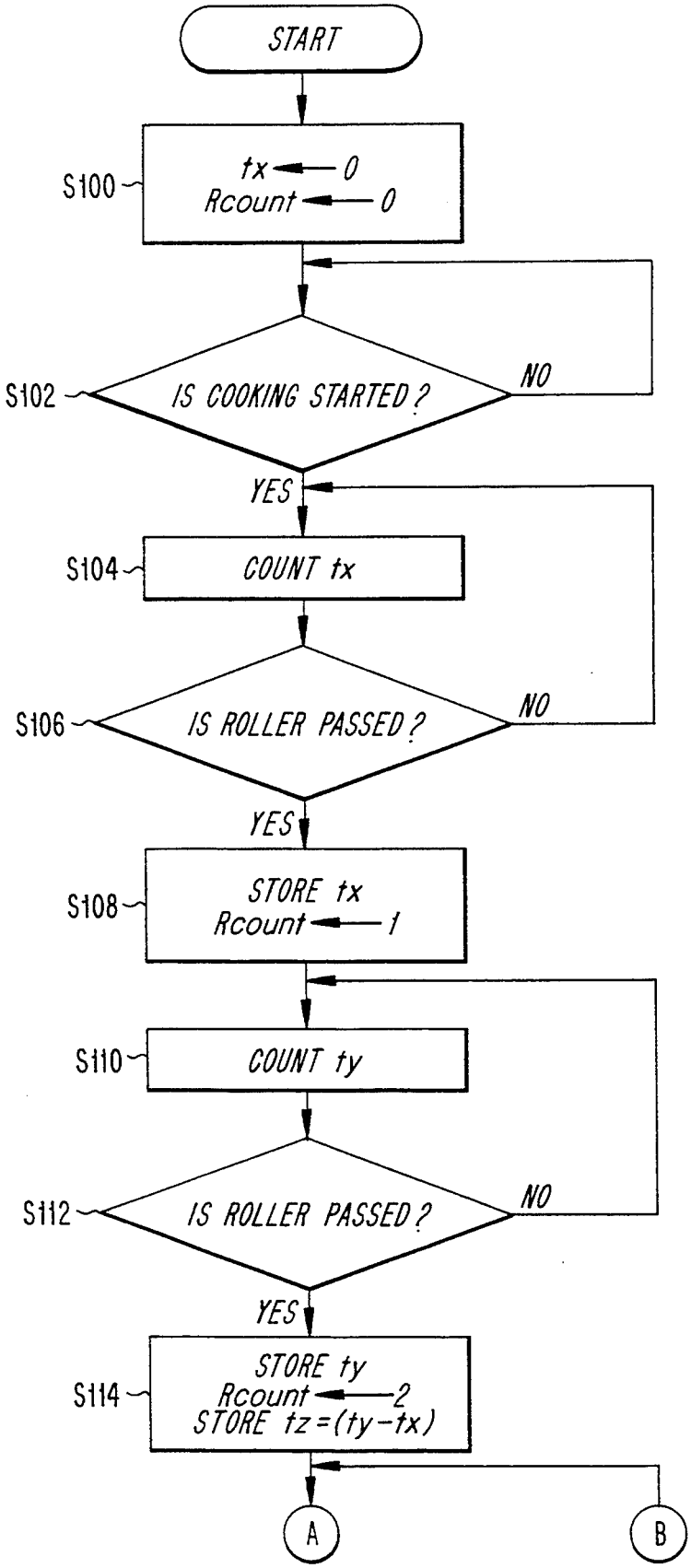
Figure 3B:
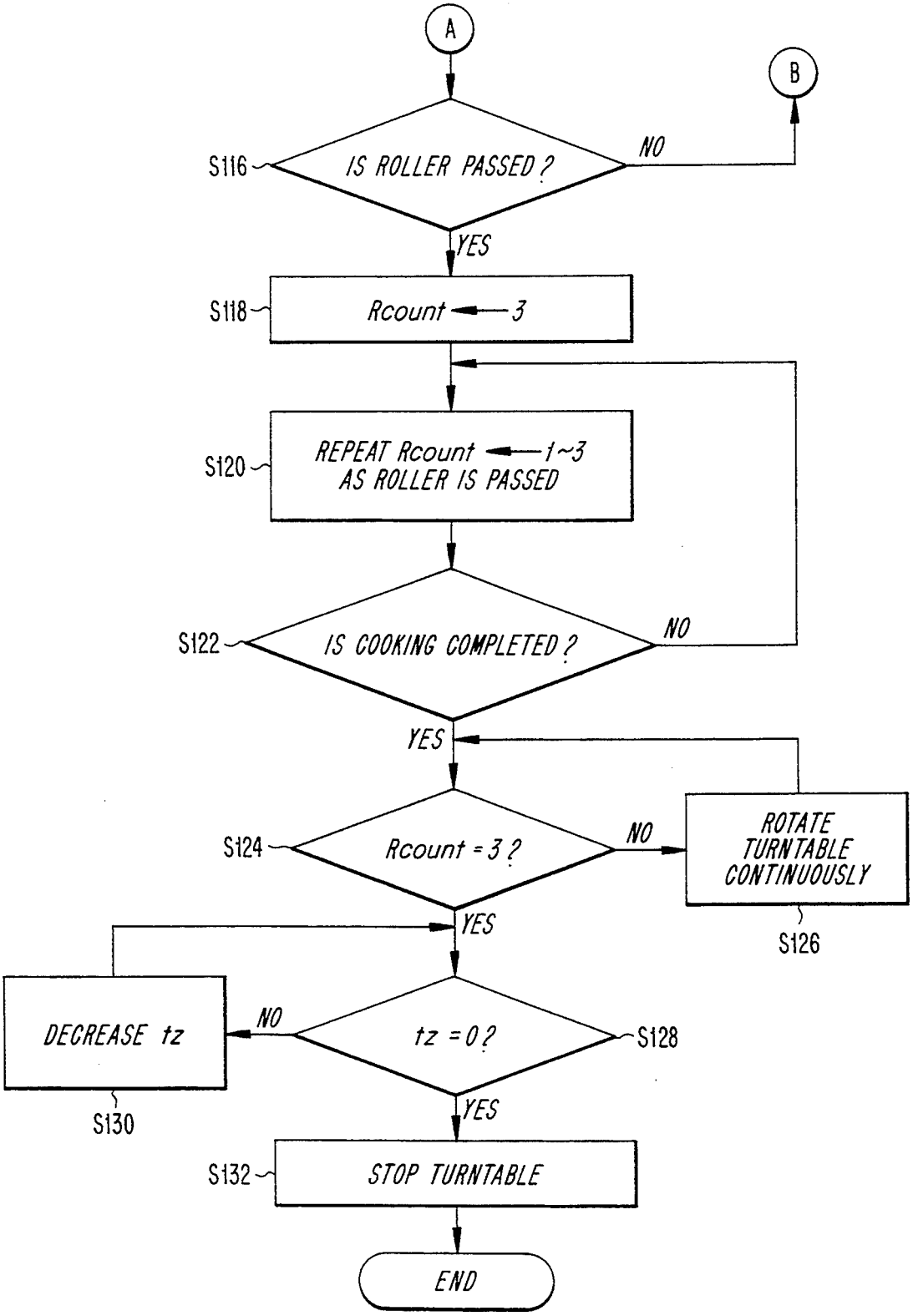

FIGS. 3A and 3B are flow charts describing a method of the present invention.

After the electric power is supplied to the microwave oven, the initiation of the process is executed in step S100, in which various counters tx and Rcount are cleared. If the user selects a cooking function, the program proceeds to Step S102 to start the cooking cycle. That is, a microwave energy generating mechanism (not shown) and a turntable rotating mechanism (not shown) are activated. At this time, the supporting rollers 41 to 43 are rotated about their axes by the friction force generated between the supporting rollers and the bottom surface 31 of the cooking compartment while supporting the turntable. In steps S104 to S108, the control section counts and stores the time (tx) from the beginning of the rotation of the turntable until the supporting roller 41, which is the first to come along in the direction of the rotation, passes by the sensing switch 50. At the same time, the value of a counter (Rcount) for the passing of the supporting roller 41 to 43 increases by 1. In step S110 and S112, the control section counts the time (ty) from the passage of the supporting roller 41 until the supporting roller 42, which comes second along the direction of the rotation, passes by the sensing switch 50. In step S114, the control section counts the time (ty) and the value of the counter (Rcount) increases by 1, again. At the same time, the control section stores the time (tz) obtained by subtracting time (tx) from time (ty). In step S116, the value of the counter (Rcount) increases by 1 when the supporting roller 43, which comes finally (in this embodiment) along the direction of the rotation, passes by the sensing switch 50. After all the supporting rollers 41 to 43 pass by the sensing switch 50 once via the foregoing steps S100 to S118, the value of the counter (Rcount) is repeatedly renewed to 1, 2 or 3 whenever the respective supporting roller 41 to 43 passes by the sensing switch 50 until the cooking cycle is completed in steps S120 and S122. Here, the completion of the cooking cycle may comprise either the actual completion of the cooking cycle of pre-set time duration according to the control program or the forced interruption of the pre-set cooking cycle by the user.

If the cooking cycle is completed in Step S122, the program proceeds to step S124, in which the control section determines whether or not the value of the counter (Rcount) is three. That is, the control section determines whether all of the supporting rollers 41 to 43 have passed by the sensing switch 50 the same number of times or not. If all supporting rollers 41 to 43 have not passed by the sensing switch 50, the program proceeds to step S126, in which the turntable continues to be rotated until all three rollers have passed by the sensing switch the same number of times. When all supporting rollers 41 to 43 have passed by the sensing switch 50 through the steps S124 and S126, the turntable continues to be rotated for the time (tz).

On the other hand, there is known a cooking appliance which automatically cooks food based on the weight of the food. Such cooking appliance comprises a weight sensor, for example, a piezoelectric transducer, mounted in the path of the supporting rollers. Accordingly, if the method of the present invention is incorporated into that cooking appliance, it is possible to sense the passage of the cooking vessel by a signal from the conventional weight sensor without requiring another sensing switch, thereby decreasing the manufacturing costs.

I claim:

1. A method for controlling the position of a cooking vessel disposed on a turntable of a cooking appliance, comprising the steps of:

A) placing said cooking vessel in an orientation on said turn-table;

B) beginning a cooking operation;

C) rotating said turntable about a vertical axis during said cooking operation so that elements carried by said turntable in equidistantly spaced relationship about said axis are sequentially sensed by a sensor arranged to sense said elements;

D) measuring a first time period (tx) from the initiation of the rotation of said turntable to the sensing of a first of said elements;

E) measuring a second time period (ty) from the sensing of said first element to the sensing of the next of said elements;

F) continuing to rotate said turntable until the completion of said cooking operation; and thereafter G) rotating said turntable until all of said elements have been sensed the same number of times and additionally for a time period equal to ty minus tx, so that said cooking vessel returns to said orientation of step A.

2. The method according to claim 1 wherein step C comprises rotating said turntable so that said elements in the form of rotary support rollers mounted on said turntable are sequentially sensed by said sensor.

3. The method according to claim 2 wherein there are at least three said elements comprising rotating said turntable so that said at least three said support rollers are sequentially sensed by said sensor.

4. The method according to claim 2 wherein step C comprises rotating said turntable during said cooking operation so that said support rollers sequentially ride over a sensor mounted in a floor of said cooking chamber.

5. The method according to claim 2 wherein step C comprises rotating said turntable during said cooking operation so that said support rollers sequentially-ride over a sensor in the form of a weight sensor mounted in a floor of said cooking chamber.

6. The method according to claim 1 wherein step F comprises continuing to rotate said turntable until the completion of a cooking operation as defined by a pre-set time duration.

7. The method according to claim 1 wherein step F comprises continuing to rotate said turntable until the completion of a cooking operation defined by the interruption of a pre-set time duration by a user.

* * * * *